United States Patent [19]

Yokozeki et al.

[11] Patent Number: 4,629,848

[45] Date of Patent: Dec. 16, 1986

[54] POWER AND TIME CONTROLLED HIGH FREQUENCY HEATING APPLIANCE

[75] Inventors: Seiki Yokozeki, Yamatokoriyama; Jun Nomura, Nara, both of Japan

[73] Assignee: Matsushita Electric Industrial Co., Ltd., Osaka, Japan

[21] Appl. No.: 819,009

[22] PCT Filed: Apr. 30, 1982

[86] PCT No.: PCT/JP82/00149

§ 371 Date: Dec. 20, 1983

§ 102(e) Date: Dec. 20, 1983

[87] PCT Pub. No.: WO83/03889

PCT Pub. Date: Nov. 10, 1983

Related U.S. Application Data

[63] Continuation of Ser. No. 574,091, Dec. 20, 1983, abandoned.

[51] Int. Cl.[4] ..... H05B 6/68

[52] U.S. Cl. ..... 219/10.55 B; 219/10.55 M; 99/325

[58] Field of Search ..... 219/10.55 B, 10.55 M, 219/10.55 R, 518; 99/325, DIG. 14

[56] References Cited

U.S. PATENT DOCUMENTS

| | | | |
|---|---|---|---|
| 4,309,584 | 1/1982 | Terakami | 219/10.55 B |
| 4,375,586 | 3/1983 | Ueda | 219/10.55 B |
| 4,413,168 | 11/1983 | Teich | 210/10.55 B |
| 4,447,693 | 5/1984 | Buck | 219/10.55 M |
| 4,517,429 | 5/1985 | Horinouchi | 219/10.55 B |

FOREIGN PATENT DOCUMENTS 56-20931 2/1981 Japan .

*Primary Examiner*—Philip H. Leung

*Attorney, Agent, or Firm*—Wenderoth, Lind & Ponack

[57] ABSTRACT

A high frequency heating appliance has a control circuit including a microcomputer wherein the number of input keys for entering the kind of heating load as well as the capacity of a ROM in the microcomputer are minimized by establishing a series of weight brackets substantially corresponding to the approximate usual weight ranges of Cornish hen, chicken, turkey, etc. to determine heating output and time based upon the kind and weight of heating load where beef and poultry are grouped into major classes and Cornish hen, chicken, turkey, etc. are grouped into sub-classes.

2 Claims, 11 Drawing Figures

| Class \ Weight | | 0 ~ 2 kg | 2 ~ 4 kg | 4 ~ 6 kg |
|---|---|---|---|---|
| 1 | | Heating output $W_1$<br>Heating time $T_1 = a_1 W$ | $W_1$<br>$T_1 = a_2 W + b_1$ | $W_1$<br>$T_1 = a_{13} W + b_{12}$ |
| 2 | | $W_2$<br>$T_2 = a_2 W$ | $W_2$<br>$T_2 = a_{22} W + b_2$ | $W_2$<br>$T_2 = a_{23} W + b_{22}$ |
| 3 | 3-1 | $W_3$<br>$T_3 = a_3 W$ | $W_3$<br>$T_3 = a_{32} W + b_3$ | $W_3$<br>$T_3 = a_{33} W + b_{32}$ |
| | 3-2 | $W_4$<br>$T_4 = a_4 W$ | $W_4$<br>$T_4 = a_{42} W + b_4$ | $W_4$<br>$T_4 = a_{43} W + b_{42}$ |
| | 3-3 | $W_5$<br>$T_5 = a_5 W$ | $W_5$<br>$T_5 = a_{52} W + b_5$ | $W_5$<br>$T_5 = a_{53} W + b_{52}$ |

| Class \ Weight | 0.15 ~ 0.7 kg | 0.7 ~ 1.5 kg | 1.5 ~ 5.8 kg |
|---|---|---|---|
| 1 | Heating output $W_1$<br>Heating time $T_1 = a_1 W$ | $W_1$<br>$T_1 = a_{12} W + b_1$ | $W_1$<br>$T_1 = a_{13} W + b_{12}$ |
| 2 | $W_2$<br>$T_2 = a_2 W$ | $W_2$<br>$T_2 = a_{22} W + b_2$ | $W_2$<br>$T_2 = a_{23} W + b_{22}$ |
| 3 | $W_3$<br>$T_3 = a_3 W$ | $W_4$<br>$T_3 = a_{32} W + b_3$ | $W_5$<br>$T_3 = a_{33} W + b_{32}$ |

POWER AND TIME CONTROLLED HIGH FREQUENCY HEATING APPLIANCE

This application is a continuation of now abandoned application Ser. No. 574,091, filed Dec. 20, 1983 now abandoned.

BACKGROUND OF THE INVENTION

A high frequency output is generally selected based upon the kind of heating load in carrying out high frequency heating and cooking. In other words, the high frequency output selected is dependent upon the constituent materials or substances of the heating load. In addition, cooking time is determined by the high frequency output selected and the weight of the heating load. Therefore, while preparing the heating load and consulting a cookbook, the user may select, calculate or determine the high frequency output and heating time in view of the kind and weight of the heating load. The cookbook generally discusses a full range of high frequency outputs and cooking times appropriate to all of the different kinds and weights of the heating loads which have been derived from preliminary or well established experiments. It is customary practice to enter those appropriate high frequency outputs and cooking times on a keyboard of the appliance. The conventional appliance requires a very complicated procedure and results in an increased possibility of faulty operation and inconvenience in use.

To accommodate a variety of different kinds of heating loads, a full range of high frequency outputs and cooking times, a microcomputer is programmed to permit all possible combinations of high frequency outputs and heating times to be established. As a result, the capacity of an ROM in the microcomputer must be very large.

A sample is illustrated in FIG. 1 which shows some examples of poultry often cooked in American homes. There are three kinds of poultry which are widely cooked in American homes: Cornish hen, chicken and turkey. It is appreciated that the high frequency outputs and heating times which are necessary to cook those kinds of poultry are as follows:

| | |
|---|---|
| Cornish hen | 700 W 7 min/0.45 kg (FIG. 1A) |
| Chicken | 700 W 6 min/0.45 kg (FIG. 1B) |
| Turkey | 490 W 5 min/0.45 kg (FIG. 1C) |

The relationships among the weight of the heating load, the heating time and the high frequency output in those cases are depicted in FIGS. 1A, 1B and 1C. Having consulting a cookbook beginning with the major classes of heating loads (in the example given, fowl) and then the sub-classes thereof (in the example given, Cornish hen, chicken and turkey), the user of the conventional appliance finds the optimum value of high frequency output and that of heating time from the book and introduces these values through high frequency output setting pads and heating time setting pads. Furthermore, the user should calculate the heating time setting by multiplying the weight of the heating load by a unit time as shown in the book. In the conventional method, it is impossible to introduce high frequency output and heating time settings without following a complex procedure. The user also feels the inconvenience in use.

An improved high frequency heating appliance of which a flow chart is illustrated in FIG. 2 has been suggested. The heating load is grouped into major classes and subclasses as follows:

| | | |
|---|---|---|
| Major class | 1 . . . beef | |
| | 2 . . . pork | |
| | 3 . . . poultry | |
| | Sub-class | 3-1 . . . Cornish hen |
| | | 3-2 . . . Chicken |
| | | 3-3 . . . Turkey |

When it is desired to effect high frequency heating on the sub-class "turkey", "major class key 1" characteristic of poultry, "sub-class key 3" characteristic of turkey and weight keys characteristic of a weight (w) are sequentially pressed. As a result, the heating time is computed and the high frequency output is selected automatically to carry out automated heating processes.

In the above conventional method, because of no linear relationship between weight and optimum cooking time, there are established several weight brackets having its unique constants assigned thereto assure approximate values of heating time. The weight brackets are usually equally spaced and, for example, every 2 kg against a maximum of 6 kg. A total of 18 constants determinative of weight-to-time relationship $a_1$, $a_{12}$, $a_{13}$, $a_2$ . . . $a_{53}$, $b_1$, $b_{12}$ . . . $b_{52}$ are required since the same weight brackets apply to the sub-class. A greater number of the major classes or sub-classes would cause a remarkable increase in the number of the constants and therefore the needed capacity of an ROM contained in a microcomputer.

SUMMARY OF THE INVENTION

Accordingly, it is an object of the present invention to provide a high frequency heating appliance which avoids the inconveniences that have been felt in use as well as undue consumption of a limited capacity of a ROM.

In essence, the weight of a heating load has a limited range mainly determined by the kind of the heating load for cooking purposes. Using the example of poultry as given above, a Cornish hen has a weight substantially between 0.15 and 0.7 kg, chicken within a range of 0.7 to 1.5 kg and turkey within a range of 1.5 to 5.8 kg. The present invention relies upon these findings. As noted earlier, the heating load has its unique weight range primarily depending upon the sub-class thereof. In other words, the kind of heating load is suggested predominantly by the weight thereof when determined. The optimum amount of heating time is decided primarily and automatically as long as the weight and kind of the heating load are already known. The optimum amount of high frequency output is dependent upon the constituent materials or substances of the heating load and in order works upon the kind (subclass) of the heating load.

Therefore, weight brackets of the heating loads, one of predominant factors of determining heating output and time, as stored in a program in a microcomputer, are brought into agreement with usual weight ranges of, for example, poultry covering Cornish hen, chicken and turkey. A selected one of heating outputs is preset for each of the weight brackets which correspond to the major classes of the heating load. Moreover, the heating time T is determined from a linear relationship $T=aw+b$ where a and b are constants and w is the weight.

In other words, the high frequency output and the heating time are determined automatically predominantly by specifying the major class and the weight of the heating load, so that heating is effected with the optimum high frequency output and the heating time which are both most suitable for the sub-class of the heating load.

As long as the above concept of programming of the microcomputer is maintained the user may conduct cooking operation at the high frequency output and heating time most suitable for the sub-class of the heating load, merely by selecting the major classes of the heating load generally known to the public and setting the weight of the heating load (i.e, without the need to select the high frequency output and the heating time or retrieve the subclass of the heating load). The present appliance is therefore very easy to operate and convenient to use without the need to consult the cook book.

As compared with the conventional appliance which requires a parallel combination of high frequency output and heating time in a stored program in a microcomputer, the present appliance requires only a series combination of these two factors in programming the microcomputer and permits the use of a cost-saving microcomputer with a decreased requirement for ROM capacity.

DETAILED DESCRIPTION OF THE INVENTION

Figure 1A:
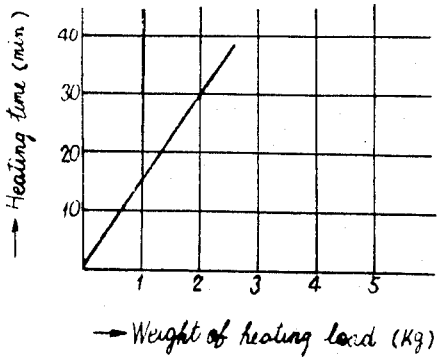
Fig. 1A PRIOR ART
FIGS. 1A, 1B and 1C are graphic representations of the relationship among weight of poultry, heating output and heating time as viewed in a conventional high frequency heating appliance.
Figure 1B:
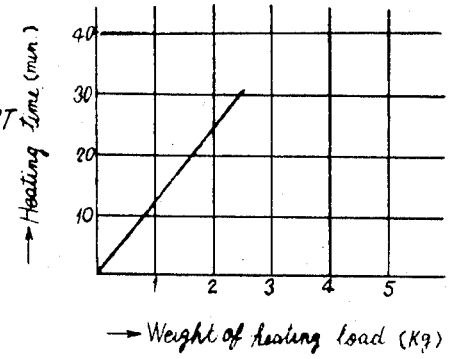
Fig. 1B PRIOR ART
Figure 1C:
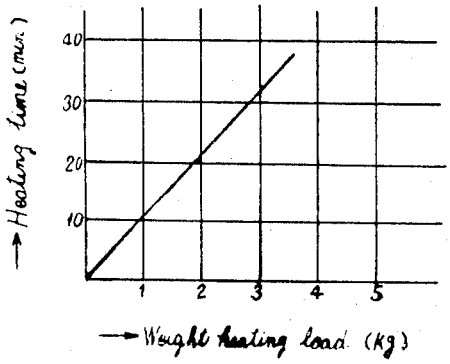
Fig. 1C PRIOR ART
Figure 2:
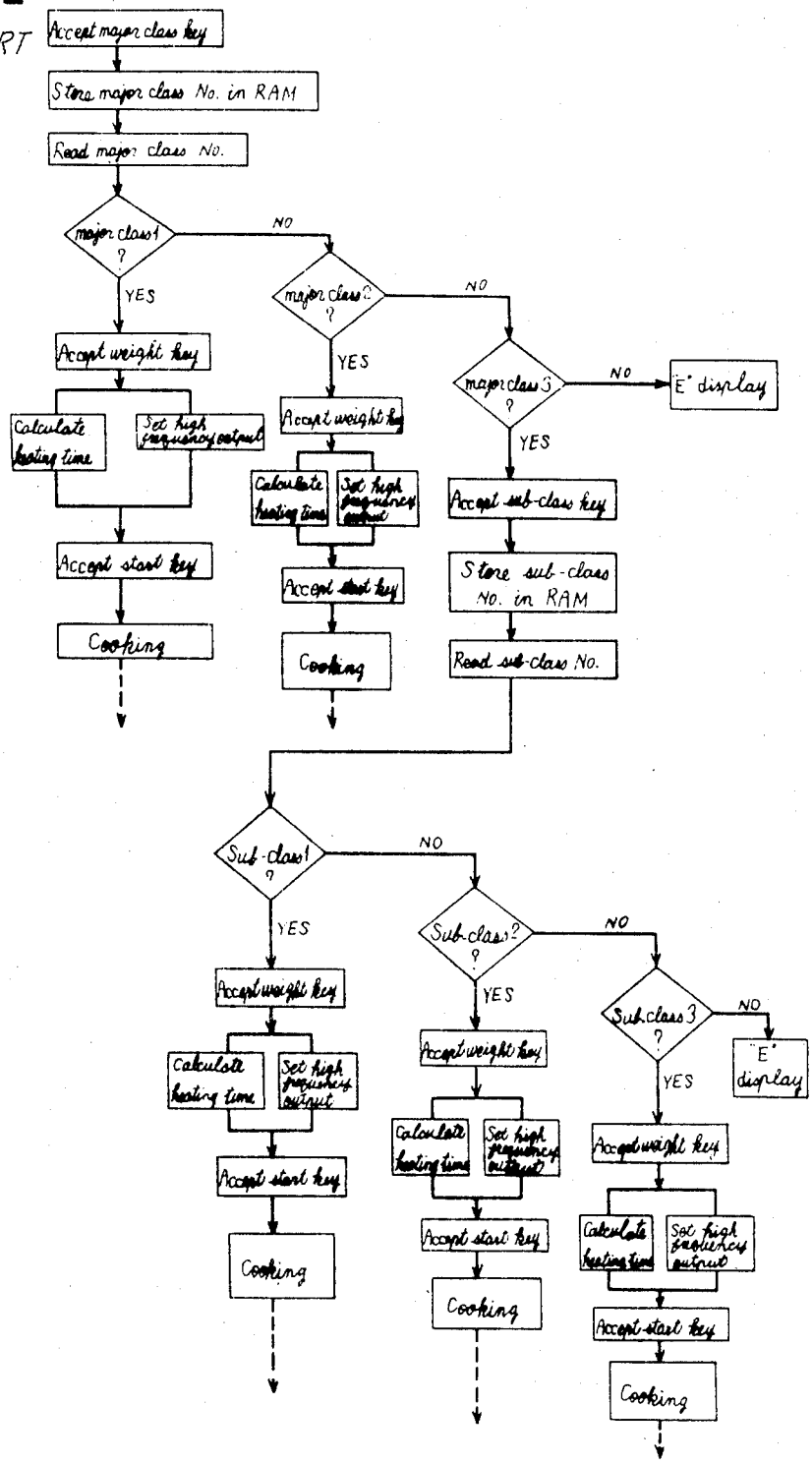
Fig. 2 PRIOR ART
FIG. 2 is a flow chart for explaining a control method in the above illustrated appliance.
Figures 3, 4:
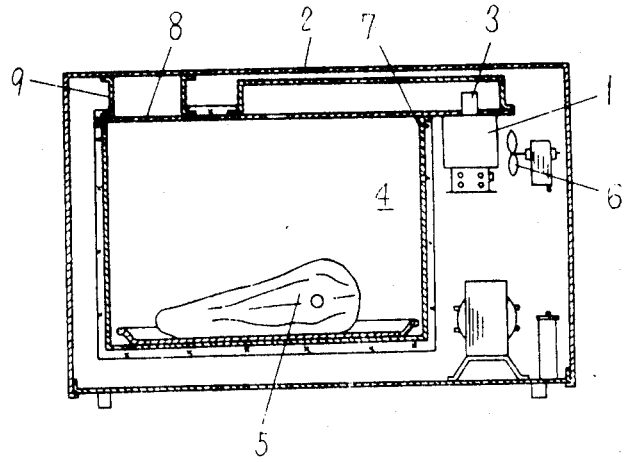
Fig. 3 PRIOR ART
FIG. 3 graphically illustrates contents of a ROM in a microcomputer.
FIG. 4 is a cross sectional front view of a high frequency heating appliance according to an embodiment the present invention.
Figure 5:
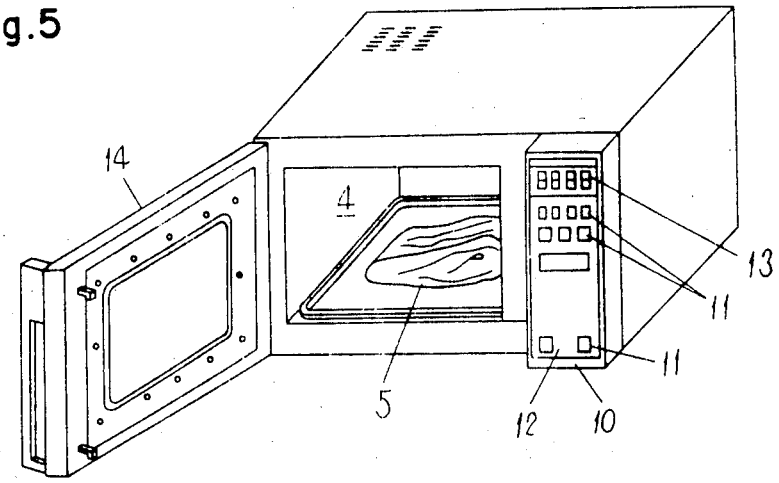
FIG. 5 is a perspective view of the appearance of the appliance as shown in FIG. 4.
Figure 6:
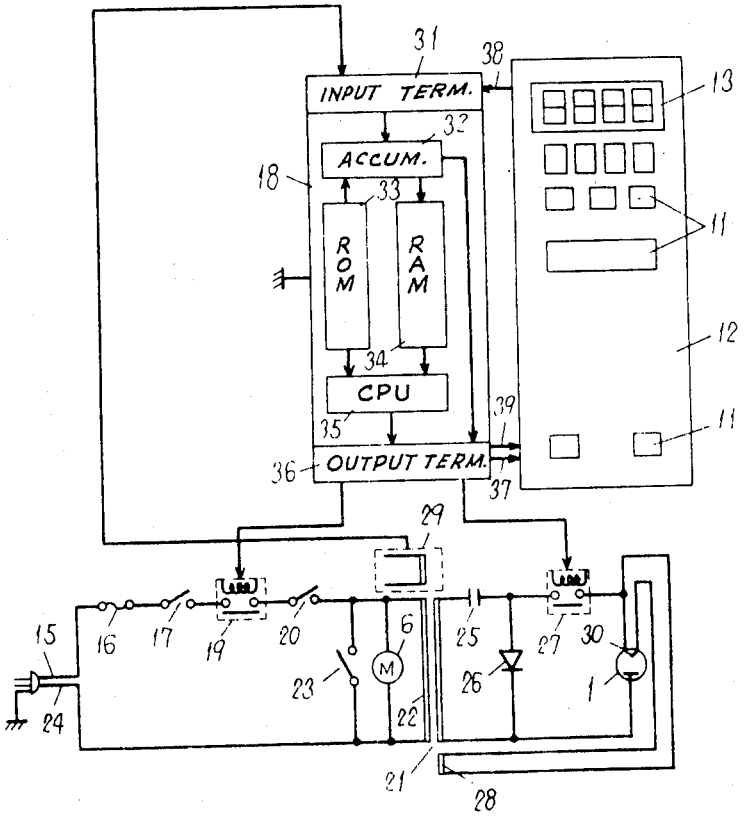
FIG. 6 is a circuit diagram of a control circuit in the same appliance.

A high frequency heating appliance according to an embodiment of the present invention is shown referring to FIGS. 4 to 6. A high frequency oscillator 1 of the design that provides microwave oscillation at 2450 MHz is coupled via a metal-made waveguide 2 and an antenna 3. High frequency waves from the high frequency oscillator 1 is directed into the waveguide 2 and radiated toward the interior of a heating chamber 4 after traveling through the waveguide 2. The high frequency waves effect dielectric heating on food 5 from inside while being absorbed by the food 5 mounted within the heating chamber 4. The high frequency oscillator 1 is subject to self-heating due to its internal loss and is therefore cooled by a blower fan 6 to prevent faulty operation during oscillation. Having cooled the high frequency oscillator 1, air fed via the blower fan passes through perforations 7 in a wall of the heating chamber 4 and enters the heating chamber 4. The air in the heating chamber 4 traverses perforations 8 in a wall of the heating chamber 4 while carrying steam generated from the food 5 during high frequency heating. Further, the air is discharged to the exterior of the high frequency heating appliance after traveling through the heating chamber 4 and a drain guide 9 communicating between the interior and exterior of the high frequency heating appliance.

A control panel 10 as shown in FIG. 5 carries a keyboard 12 including a plurality of key pads 11 manually operable by the user for introducing heating output, heating time and heating mode settings and display elements 13 such as LEDs and fluorescent display tubes for displaying the heating output, time and mode settings. A freely openable and closable door 14 provides access to the heating chamber 4 for the food 5. A control circuit of the high frequency heating appliance will now be described by reference to FIG. 6.

The high frequency heating appliance is usually plugged into a plug receptacle in a house for supplying power supply via a power plug. One end 15 of the power plug is connected to a open 16 which will fuse in response to operation of a short switch for preventing leakage of a substantial amount of microwaves if any electric components of the high frequency heating appliance is shortcircuited or grounded or an interlock as described below becomes melted. Further, the interlock 17 whose contact is opened and closed upon opening and closing movement of the door 14 is connected to the fuse 16. The interlock 17 is also connected to relay 19 which is switched on to initiate heating in response to a heating start command from a microcomputer 18 and switched off in response to an end or halt command from the same. The relay 19 is connected to a second interlock 20 whose contact is opened and closed upon movement of the door 14 for provision of doubled safeguard. The interlock 20 is connected to a primary winding 22 of a high voltage transformer 21. Connected across the primary winding 22 of the high voltage transformer 21 are the cooling fan 6 and the above mentioned short switch 23 which works to render the whole of the circuit inoperable when the interlock 17 or 20 becomes melted. The remaining end 24 of the power plug is connected directly to the primary winding 22 of the high voltage transformer 21. An AC power input to the high voltage transformer 21 is boosted into a high voltage power output through operation of the high voltage transformer 21. The resultant high voltage power output is multiplied and rectified into a high voltage DC power output through a voltage multiplier and rectifier composed of a high voltage capacitor 25 and a high voltage diode 26. The high voltage DC power output is fed to the high frequency oscillator 1 via a high voltage switch 27 switchable in a given cycle, to thereby permit the amount of the high frequency output to be variable. The high voltage DC power output supplied to the high frequency oscillator 1 is converted into high frequency radiations in the high frequency oscillator 1 and the radiations are delivered from the antenna 3. The high frequency waves serve to heat the food 5 in the above described manner.

The high voltage transformer 21 further includes a heater winding 28 and a biquadratic winding 29, with the heater winding 28 leading to a heater 30 of the high frequency oscillator 1 for heating the heater. The function of the biquadratic winding 29 is to find that the door 14 has been opened in the course of heating and the interlocks 17 and 20 have been switched off to interrupt AC power supply to the high voltage transformer 21 and to inform the microcomputer 18 of this finding and eventually deenergize the relay 19. It is noted that the high voltage switch 27 is switched on and off at the given interval in response to commands from the microcomputer 18 when heating output is set upon the user's actuation of the output setting key.

The operation of the above construction will be described below.

The microcomputer 18 plays an important role in the whole of the control circuit. The primary function of the microcomputer 18 is to control peripheral circuits, analyze and calculate information from the peripheral circuits and then control the peripheral circuits according to the results of such analysis and calculation. The microcomputer 18 has input terminals 31 for receipt of information characteristic of selected ones of heating output, time and modes as introduced via the keyboard 12, a cooking interruption command from the biquadratic winding 29 of the high voltage transformer 21, etc.; an accumulator 32 for temporarily storing the commands, the information, etc. for comparison with data contained in a ROM area stated below, transmission into a RAM or a central processing unit and so forth; the ROM 33 for storing all of the commands and information necessary for controlling the whole system; the RAM 34 for storing the information and data fed from the input terminals 31; the central processing unit 35 for analyzing and calculating the information, data and various commands; and output terminals 36 for delivering output signals for controlling the peripheral circuits according to the resultant data.

The output terminals 36 of the microcomputer 18 feed the output signals to the input terminals 37 on the keyboard 12 so that output signals will be available at the keypads 11 on the keyboard 12. A signal received by an input terminal 31 is temporarily loaded into the accumulator 32 via the input terminals 31 of the microcomputer 18 for subsequent comparison with the data in the ROM 33, transmission to the RAM 34 or the central processing unit 35 and calculation in the central processing unit 35. If the case permits, signals resulting from the calculation are transferred from the output terminal 36 to the peripheral circuits such as the display 13, the relay 19 and the high voltage switch 27 to enable the same. Actuations of the keyboard 12 by the user and in other words information characteristic of the heating time and high frequency output settings is fed into the microcomputer 18, thus opening and closing the relay 19 in response to the heating time settings and switching on and off the high voltage switch 27 in response to the high frequency output settings.

The output terminals 39 of the microcomputer 18 deliver the output signals to the display tubes 13 on the control panel 10 for the purpose of displaying the cooking output, time and modes settings.

Figures 7, 8:
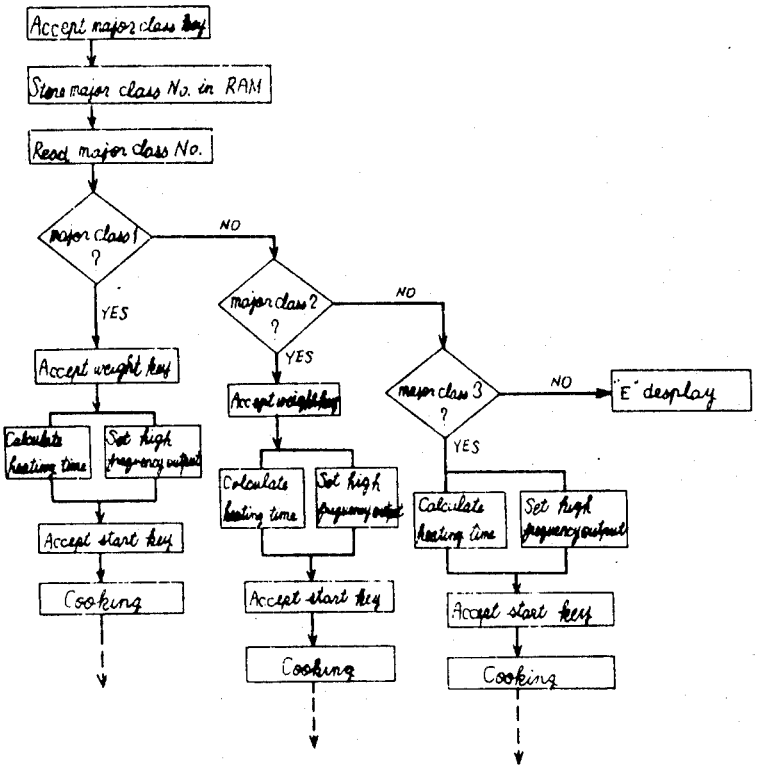
FIG. 7 is a flow chart for explaining a control method in the appliance.
FIG. 8 is a graphic illustration of part of contents of a ROM in a microcomputer.

FIG. 7 shows a flow chart drawn in conjunction with the microcomputer 18. When a major class key "3" characteristic of poultry on the key pads 11 is selected and then the weight keys on the key pads 11 are actuated to key in "2.0 kg", the optimum amount of heating time and the optimum amount of high frequency output are automatically decided and auto cooking operation is executed upon subsequent depression of a start key.

FIG. 8 graphically represents the contents of the ROM in the microcomputer 18. In the example given, there are defined three weight brackets" "0.15–0.7 kg", "0.7–1.5 kg" and "1.5–5.8 kg". These weight brackets correspond to the actual weights of the load in the sub-classes "Cornish hen", "chicken" and "turkey" in the case of poultry. For example, "Cornish hen" which is widely used in home cooking falls within a weight range of "0.15 to 0.7 kg". The optimum heating conditions for each of these weight brackets are established by heating outputs $W_1$, $W_2$, . . . $W_5$ (in watts) and constants $a_1$, $a_{12}$, . . . $a_{53}$ and $b_1$, $b_{12}$, . . . $b_{52}$ which define heating time slots $T_1$, $T_2$, . . . $T_5$. In the case of beef, major class No. 1 and pork, major class No. 2 different from poultry having the sub-classes, the same results of cooking are equally available from the same program relying upon establishment of the weight brackets as taught in the above embodiment.

Figure 9:
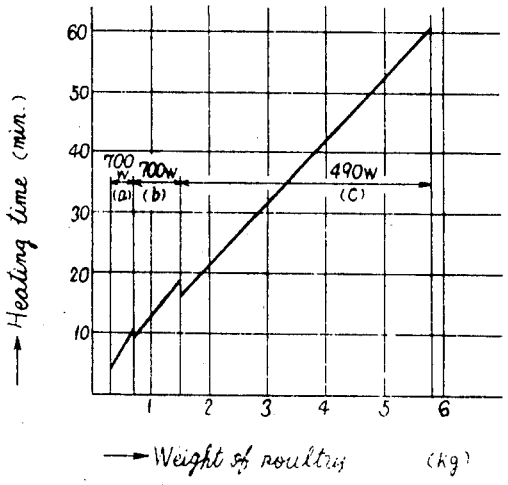
FIG. 9 is a graph showing the relationship among weight of poultry meat, heating output and heating time in the appliance.

FIG. 9 typically shows the relationship among the weight of poultry, heating output and heating time, in which heating is effected with a heating time as determined by a graph plotted with a straight line in zone "a" and 700 watts of output when weight is inputted within a range of "0.15 to 0.7 kg".

TABLE

| Input item | | Automatically-decided item | | | |
|---|---|---|---|---|---|
| Major class | Weight kg | High frequency output W | Heating time | Corresponding sub-class | Zone in FIG. 5 |
| Poultry | 0.15–0.7 | 700 | 2'20"–10'53" | Cornish hen | (a) |
| | 0.7–1.5 | 700 | 9'20"–20' | Chicken | (b) |
| | 1.5–5.8 | 490 | 16'40"–64'27" | Turkey | (c) |

In this manner, satisfactory auto cooking is expected only when the user selects one of the major class selection keys and input the actual weight of the load.

As is clear from the foregoing, the high frequency heating appliance embodying the present invention applicable as microwave ovens for home or business use is adapted such that it performs automatic determinations as to high frequency output and heating time if the kind (major class) and the actual weight of the heating load are keyed in. Advantageously, the present appliance provides convenience for the user's use, simplicity of the stored program in the microcomputer, minimum numbers of steps to be stored in the ROM and RAM and corresponding decreases in the capacities of the ROM and RAM.

We claim:

1. A high frequency heating apparatus comprising a heating compartment to keep food to be heated, a high frequency oscillator for heating the food by radiating high frequency waves into said heating compartment, a control circuit unit possessing a program function and containing a microcomputer for controlling an output of high frequency oscillator, selection keys for selecting a major classification of the food and for feeding this classification information into said control circuit unit, and a weight key for feeding the weight of the food into said control circuit unit, wherein said control circuit unit includes a determination means for determining a minor classification of the food based on the major classification of the food from said selection keys and the weight of the food from said weight key and also includes a setting means for setting the output of the waves from said oscillator and a heating time T based on the minor classification from the determination means and the weight from said weight key, and wherein said heating time T is determined from the following formula, assuming that the constants set in accordance with the minor classification from said determination means are a and b and the weight of the food is W:

$$T=a+bW.$$

2. A high frequency heating apparatus as set forth in claim 1, wherein, when the major classification of food is poultry, the minor classifications are Cornish hen, chicken, and turkey according to the weight class, and the high frequency output and heating time are determined for each minor classification.

* * * * *